US007034715B2

(12) United States Patent
Gila et al.

(10) Patent No.: US 7,034,715 B2
(45) Date of Patent: Apr. 25, 2006

(54) DEVICES AND METHODS FOR SIMPLIFYING OCR -BASED ENFORCEMENT IN AUTOMATIC TOLL SYSTEMS

(75) Inventors: Janos Gila, Mödling (AT); Wolfgang Konrad, Mödling (AT)

(73) Assignee: Siemens Aktiengesellschaft, Munich (DE)

( * ) Notice: Subject to any disclaimer, the term of this patent is extended or adjusted under 35 U.S.C. 154(b) by 218 days.

(21) Appl. No.: 10/480,432

(22) PCT Filed: Jun. 12, 2002

(86) PCT No.: PCT/DE02/02155

§ 371 (c)(1),
(2), (4) Date: Dec. 12, 2003

(87) PCT Pub. No.: WO02/101662

PCT Pub. Date: Dec. 19, 2002

(65) Prior Publication Data

US 2004/0193481 A1 Sep. 30, 2004

(30) Foreign Application Priority Data

Jun. 12, 2001 (AT) ..... A 911/2001

(51) Int. Cl.
*G08G 1/00* (2006.01)
*G08G 1/065* (2006.01)

(52) U.S. Cl. ..... 340/928; 340/933; 235/384

(58) Field of Classification Search ..... 340/928, 340/933, 937, 939, 5.2; 235/384; 398/151
See application file for complete search history.

(56) References Cited

U.S. PATENT DOCUMENTS

| | | | | |
|---|---|---|---|---|
| 5,872,525 | A * | 2/1999 | Fukasawa et al. | 340/928 |
| 6,111,524 | A * | 8/2000 | Lesesky et al. | 340/942 |
| 6,157,314 | A * | 12/2000 | Loftus | 340/5.2 |
| 6,388,581 | B1 | 5/2002 | Barker et al. | |
| 6,538,579 | B1 * | 3/2003 | Yoshikawa et al. | 340/928 |
| 6,583,732 | B1 * | 6/2003 | Bervoets et al. | 340/933 |
| 6,653,946 | B1 * | 11/2003 | Hassett | 340/928 |
| 6,683,580 | B1 * | 1/2004 | Kuramoto | 343/721 |
| 6,737,986 | B1 * | 5/2004 | Fuyama | 340/928 |

FOREIGN PATENT DOCUMENTS

| | | |
|---|---|---|
| DE | 4446674 | 6/1996 |
| DE | 19836087 | 2/2000 |
| GB | 2295476 | 5/1996 |
| WO | WO 9607168 | 3/1996 |
| WO | WO 99/66455 | 12/1999 |

OTHER PUBLICATIONS

Rozek W.: "Mautsysteme Aus Der Hochtechnologiest ADT Jeda", NTZ Nachrichtentechnische Zeitschrift, VDE Verlag GMBH. Berlin, DE, vol. 47, No. 6, 1994, pp. 388-392, XP000996921, ISSN: 0027-707X.

* cited by examiner

*Primary Examiner*—John Tweel, Jr.
(74) *Attorney, Agent, or Firm*—Harness, Dickey & Pierce P.L.C.

(57) ABSTRACT

A method if for monitoring the regular operation of a charging device for a vehicle with a vehicle characteristic number. At least one given optical pattern/signal is generated on the vehicle, which is characteristic for the operating state of the charging device.

27 Claims, 3 Drawing Sheets

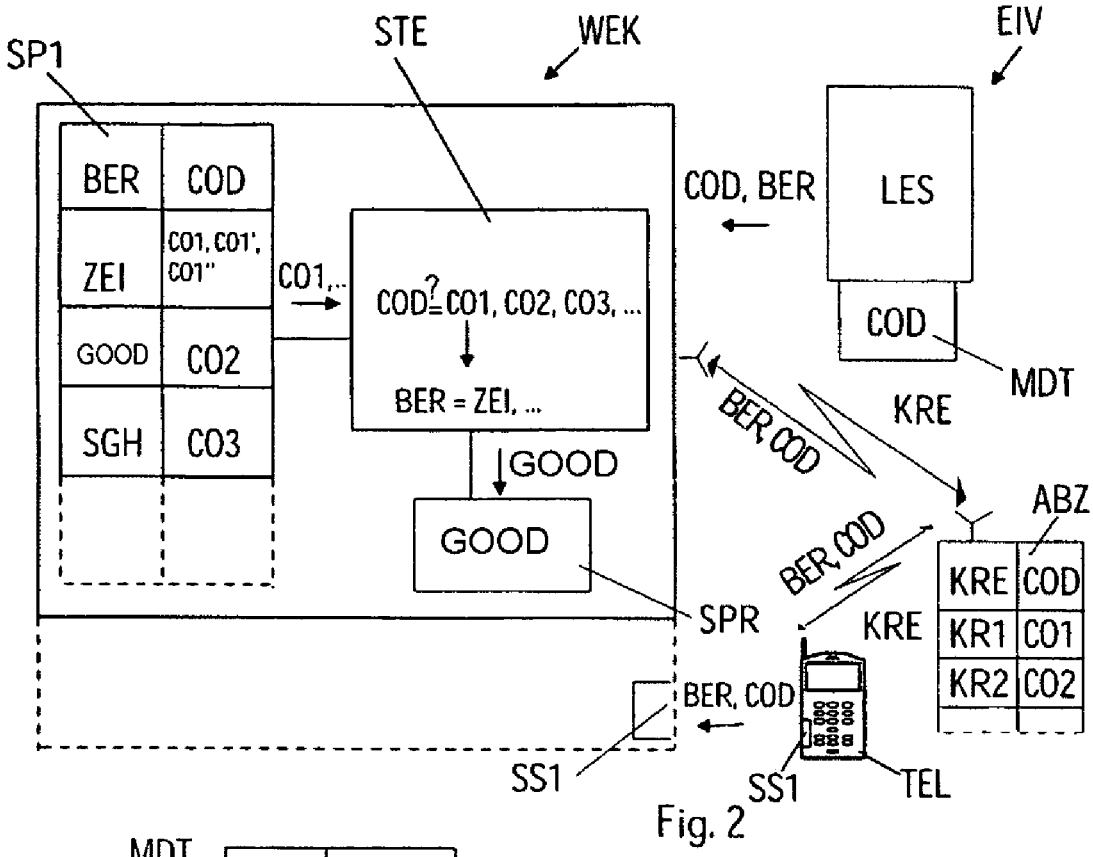
Fig. 2
MDT
| COD | WER |
|---|---|
| CO1 | "VALID" |
Fig. 3
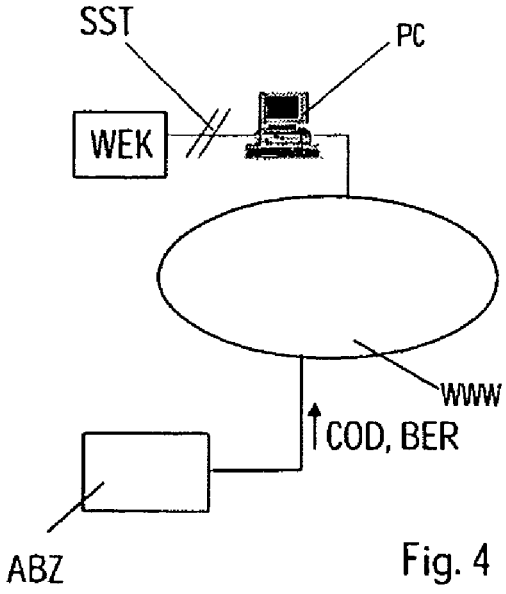
Fig. 4

DEVICES AND METHODS FOR SIMPLIFYING OCR -BASED ENFORCEMENT IN AUTOMATIC TOLL SYSTEMS

This application is the national phase under 35 U.S.C. § 371 of PCT International Application No. PCT/DE02/02155 which has an International filing date of Jun. 12, 2002, which designated the United States of America and which claims priority on Austrian Patent Application number AT 911/2001 filed Jun. 12, 2001, the entire contents of which are hereby incorporated herein by reference.

FIELD OF THE INVENTION

The invention generally relates to a method for monitoring the correct operation of a toll payment apparatus for a vehicle with a vehicle identification.

The invention also generally relates to a monitoring system for monitoring the correct operation of a toll payment apparatus for a vehicle identification.

BACKGROUND OF THE INVENTION

In automatic toll systems, a license number identification which is based on optical pattern recognition or "Optical Character Recognition" OCR for short, is frequently used in the course of monitoring correct payment of the toll fees and for identification of toll infringes, with a high probability of identification normally being required. The performance of OCR is highly dependent on the environmental conditions (weather), and requires either a high degree of local computation power or a large amount of data to a central OCR host.

In some toll systems, the toll fees are paid continuously by communication with the toll infrastructure or via devices which are similar to repayment cards. In the first case, the identity of the vehicle is not known in the latter. In both cases, however, correct payment of the toll fees must be monitored, and potential toll infringes must be identified.

One system of the type mentioned initially is described, for example, in WO 99/66455. In this case, an apparatus for monitoring the correct operation of a toll payment apparatus is arranged at the side of the road, with the toll payment apparatus being arranged in a vehicle that is passing the apparatus and has a license plate, and with communication taking place between the toll appliance and the apparatus. If, on the basis of the communication with the toll payment apparatus, the apparatus identifies that the toll payment apparatus is not being operated correctly, then the license plate of the vehicle is recorded by way of a recording device.

However, this apparatus has the disadvantage that a communication link must be set up between the toll appliance and the apparatus, for which reason the production of this apparatus is associated with high costs.

SUMMARY OF THE INVENTION

One object of an embodiment of the invention is thus to provide a device which allows toll infringes to be identified and correct operation of the toll payment device to be identified in a simple and cost-effective manner.

According to an embodiment of the invention, an object may be achieved by a method of the type mentioned initially in that at least one optical pattern/signal, which is characteristic of the operating state of the toll payment apparatus and can be predetermined, is produced in the area of the front of the vehicle.

In one advantageous variant of an embodiment of the invention, the optical pattern/signal which can be predetermined is produced by way of at least one light-emitting diode.

In one preferred embodiment of the invention, the optical pattern/signal is an infrared pattern/signal with the light-emitting diode being an infrared light-emitting diode.

Further advantages can be achieved by the optical pattern/signal being detected by way of an optically sensitive sensor.

Furthermore, the optical pattern/signal can be detected by way of an infrared camera.

In order to produce a pattern/signal which corresponds to incorrect operation of the toll payment apparatus, the license number of the vehicle can be recorded as it passes a monitoring point.

An apparatus which is designed to produce at least one optical pattern/signal which is characteristic of the operating state of the toll payment apparatus and can be predetermined, in the area of the front of the vehicle, is particularly suitable for carrying out the method according to an embodiment of the invention.

At least one light-emitting diode is advantageously provided in order to produce the optical pattern/signal which can be predetermined.

In one preferred embodiment of the invention, the apparatus is designed to produce an infrared pattern/signal, in which case an infrared light-emitting diode may be provided in order to produce the infrared pattern/signal.

The monitoring system is advantageously designed to detect the optical pattern/signal by way of an optically sensitive sensor.

Furthermore, the monitoring system may be designed to detect the optical pattern/signal by way of an infrared camera.

Further advantages can be achieved by the monitoring system being designed to record the license number of the vehicle as it passes a monitoring point, in order to produce a pattern/signal which corresponds to incorrect operation of the toll payment apparatus.

BRIEF DESCRIPTION OF THE DRAWINGS

The invention together with further advantages will be explained in more detail in the following text with reference to a number of exemplary embodiments, which do not restrict the scope of the invention and are illustrated in the drawing, in which, illustrated schematically:

FIG. 2 shows the toll payment apparatus as shown in FIG. 1 in more detail, and a reader for booking a user authorization to the toll payment apparatus;

FIG. 3 shows a magnetic card with a code for booking a user authorization to the toll payment apparatus;

FIG. 4 shows a toll system with a vehicle-external billing center in addition to the toll payment apparatus within the vehicle;

DETAILED DESCRIPTION OF THE PREFERRED EMBODIMENTS

Figure 1:
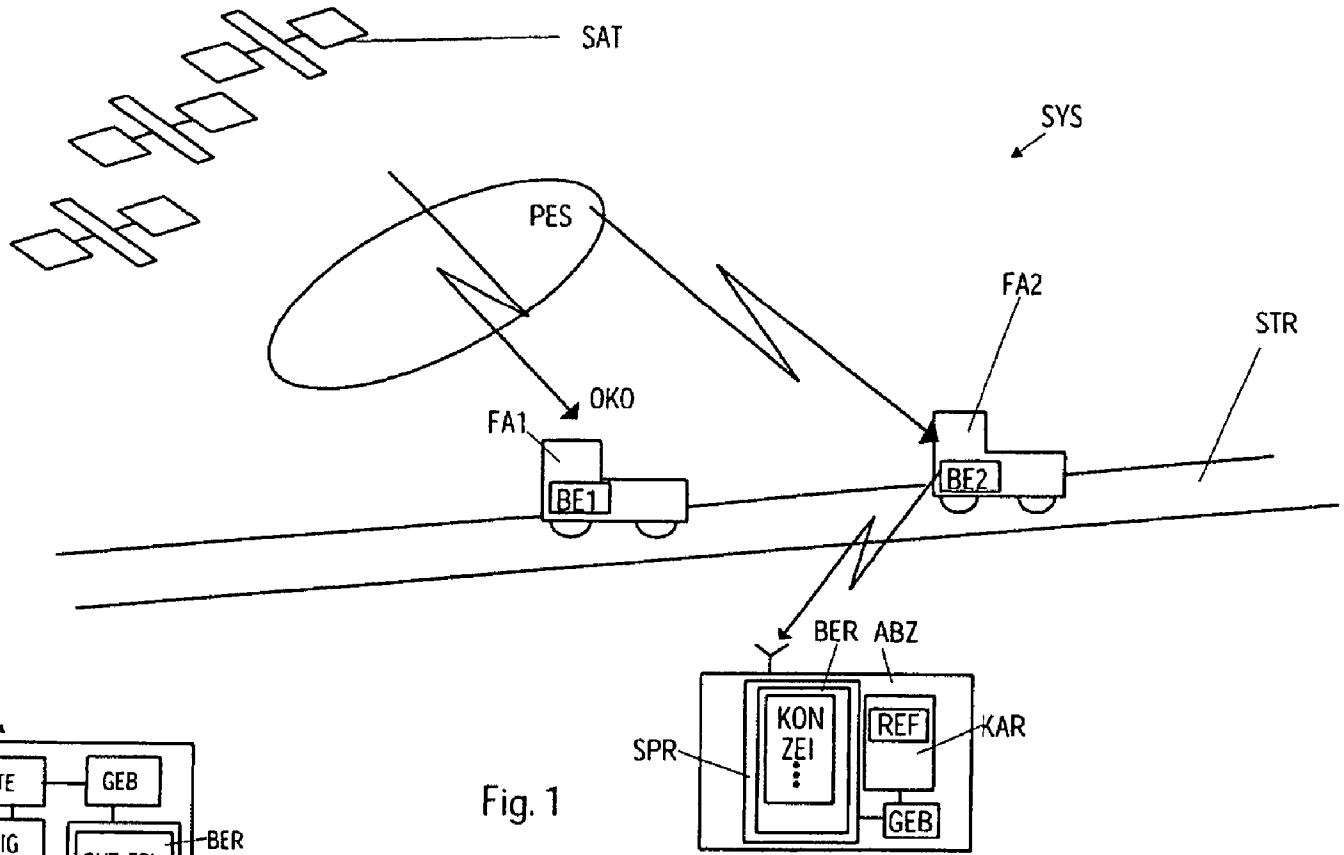
FIG. 1 shows a system for recording and payment of toll fees by way of a toll payment apparatus, which is arranged on board the vehicle, for determination of the toll fees.
Figure 1A:
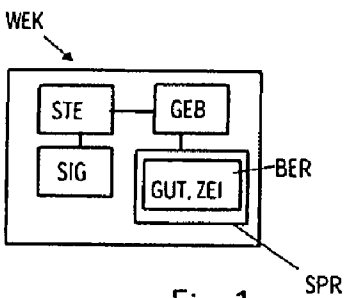
FIG. 1*a* shows the toll payment apparatus as shown in FIG. 1, in more detail.

As is illustrated in FIG. 1, a toll system SYS may have a position finding system PSE, for example the known "Global Positioning System" or GPS system for short, in order to locate the position of a vehicle FAR.

In this case, the vehicles, FA1, FA2 may have the toll payment apparatuses BE1, BE2 which are designed to receive data from the position finding system PSE and to use this to calculate the position coordinates OKO of the vehicles, FA1, FA2. The route STR which has been traveled can be determined on the basis of the position coordinates OKO, for example on the basis of a signature SIG which is calculated from the position coordinates OKO. Furthermore, if the route STR on which a vehicle FA1, FA2 is driving is subject to a toll, a check can be carried out to determine whether the vehicle FA1, FA2 is authorized to use the route that is subject to a toll.

The usage authorization BER may, for example, be in the form of a credit GUT and be stored in a memory SPR for the toll payment apparatus BE1, in which case this toll payment apparatus BE1 may be designed to calculate the toll fees GEB which are incurred, and to debit them from the credit GUT. If the credit GUT has been consumed and there is no further usage authorization BER, then the vehicle FAR can no longer use routes STR which are subject to tolls. The toll payment apparatus BE1, with a usage authorization BER stored in it, is referred to in the following text as a prepayment card WER.

The usage authorization BER need not necessarily be a credit GUT. The usage authorization BER may, for example, also be in the form of a time card ZEI, which is stored in the memory SPR of the prepayment card WER and which authorizes the use of routes STR which are subject to tolls and can be predetermined within a certain time period, etc. (FIG. 2).

The type of usage authorization BER which is desired by a vehicle keeper (credit, time card, route credit, timings etc) may, for example be transferred to the toll payment apparatus BEV as a code COD. Any type of usage authorization BER may in this case be assigned a code CO1, CO2, CO3, which can be predetermined, in a memory unit SP1 for the toll payment apparatus BEV (FIG. 2). It is thus possible, for example to allocate a first code CO1 to a time card ZE1 for all the routes STR that are subject to tolls in a region which can be predetermined, while another code CO2 charges a credit GUT by an amount which can be predetermined, or a third code CO3 increases a route credit SGH by an amount which can be predetermined, etc.

After receiving the code COD, the controller STE for the toll payment apparatus BEV can identify and enable or activate the appropriate usage authorization BER by comparison of the code COD that has been obtained by the user with the codes CO1, CO2, CO3 which are stored in the memory unit SP1.

The code COD may be transmitted, for example, by way of an input apparatus EIV which is connected to the prepayment card WEK by cable or without the use of cables. Examples of a cable-based connection between the input apparatus EIV and the toll payment apparatus BEV include copper wire, glass fiber, etc. Examples of a connection without the use of cables are radio, infrared transmission, laser, etc.

In order to prevent the prepayment card WEK from being loaded with a usage authorization BER by misuse, the code CO1, CO2, CO3 may be scrambled and may be transmitted to the prepayment card WEK in a form which cannot be identified by the user.

For example, the code COD may be stored in a mobile data storage medium. In this case, the input apparatus EIV is in the form of a reader LES for mobile data storage media, in order to transmit the user authorization BER or the code COD to the toll payment apparatus. In order to prevent the mobile data storage medium from being reused as a form of misuse, the reader LES may be designed to end the transmission process of the code COD to the toll payment apparatus BEV with a cancellation of the mobile data storage medium. This cancellation may, for example, include the information which is contained in the mobile data storage medium being erased by the reader, or a value WER which indicates the validity of the mobile data storage medium being set from "valid" to "invalid" (FIG. 3).

As is shown in FIG. 4, a communication link can also be set up between the toll payment apparatus BE2 and a billing center ABZ, in which case the user authorization BER may be provided in the billing center, preferably in the form of an account KON which is associated with the vehicle and from which toll fees GEB which are incurred can be debited.

In the following text, the toll payment apparatus BE2 which can interchange data with the billing center ABZ is referred to as a calculation unit OBU.

Figure 5:
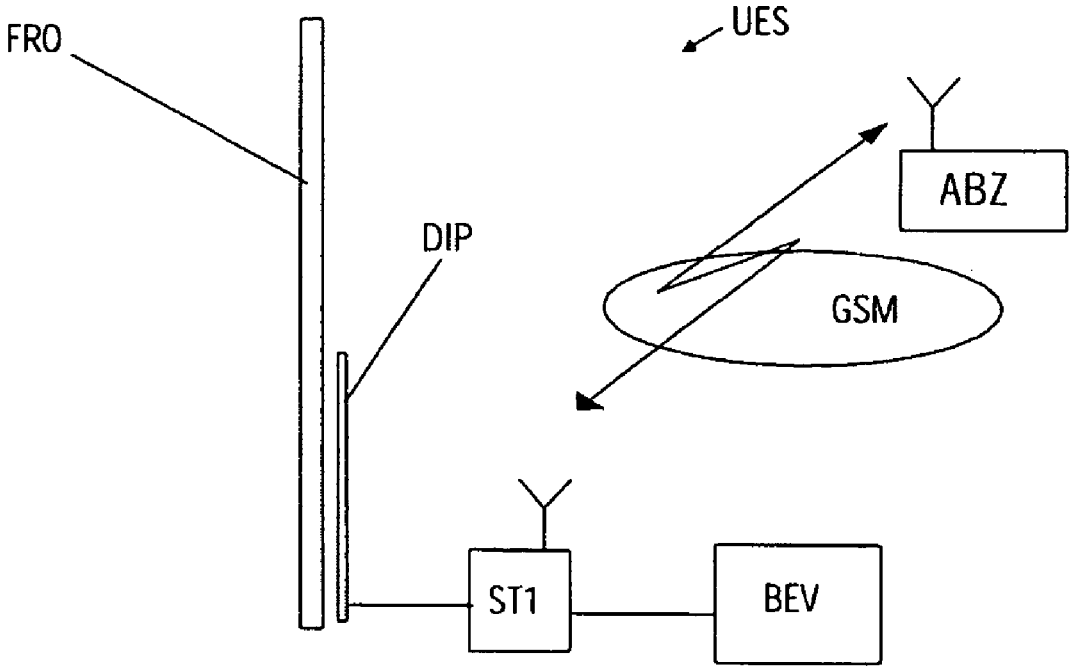
FIG. 5 shows a monitoring system according to an embodiment of the invention.
Figure 6:
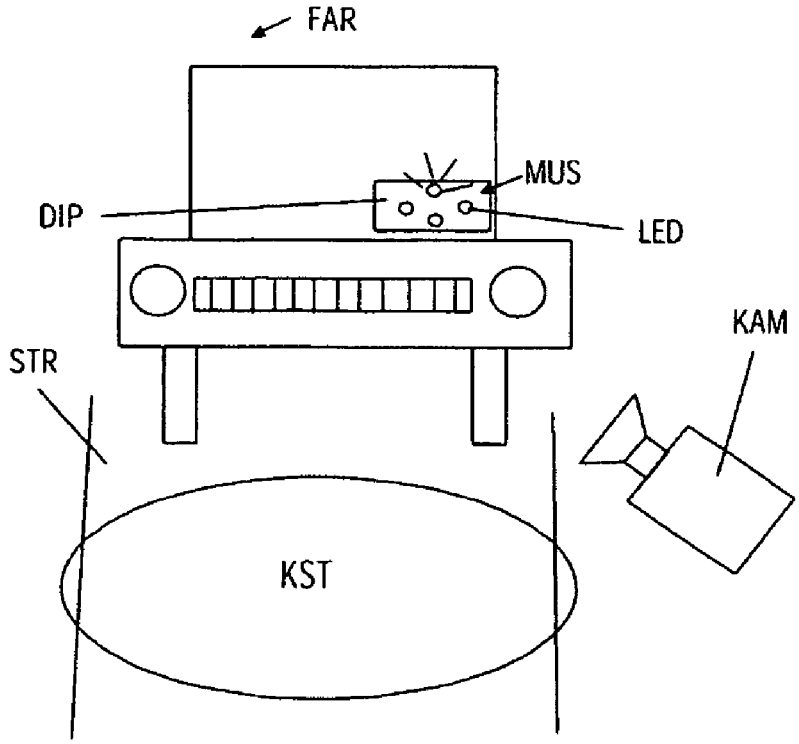
FIG. 6 shows a display for enforcement indication, which is arranged in the front windshield of a vehicle.

As is shown in FIG. 5, a monitoring system UES according to an embodiment of the invention for monitoring the correct operation of a toll payment apparatus BEV has a controller ST1 as well as a display DIP which is connected to it and is designed to display a pattern MUS which can be predetermined (FIG. 6). The optical pattern MUS depends on the current operating state of the toll payment apparatus BE1, BE2, for example whether there is a valid usage authorization BER or whether the toll payment apparatus BE1, BE2 is switched on.

In order to display the pattern MUS as a function of the operating state of the toll payment apparatus BE1, BE2, the controller ST1 can monitor the status of the usage authorization BER in the prepayment card WEK and in the billing center ABZ, and can monitor whether the toll payment apparatus BE1, BE2 is switched on or off.

The controller ST1 controls the display DIP as a function of the operating state of the toll payment apparatus BE1, BE2, with a pattern MUS which corresponds to the current operating state being displayed on this display DIP. The display DIP may have light-emitting diodes LED or infrared light-emitting diodes in order to display the pattern MUS.

If the usage authorization BER is stored in the billing center ABZ, then the calculation unit OBU may be designed to check the status of the usage authorization BER at time intervals which can be predetermined, via a radio network FUN, for example the GSM network, and to store this.

If no valid user authorization BER exists for the calculation unit OBU, then an optical pattern MUS which is provided for this purpose is displayed on the front of the vehicle FRO.

Impermissible manipulations of the prepayment card WEK or of the calculation unit OBU by the driver can be identified by the controller ST1 for the monitoring system UES which is associated with the corresponding vehicle FA1, FA2. For example, the controller ST1 for the monitoring system may be designed to display a pattern MUS, which is provided for this purpose, on the display, for example an illuminated light-emitting diode LED, if a false code COD for a user authorization MED is entered in the prepayment card WEK more than once.

If the user authorization BER is stored in the prepayment card WEK, that is to say if no link is provided between the toll payment apparatus BEV and a billing center ABZ for a toll operator, the inputting of the entry or exit to or from a route STR which is subject to a toll. Thus, the activation of the toll payment apparatus BEV, can be carried out by the driver of the vehicle FAR by way of a suitable input apparatus, for example a button on the prepayment card WEK.

This allows the vehicle driver to have the obligation to carry out an action in a similar way to the cancellation of a tram ticket.

If the prepayment card WEK has been switched on by the vehicle user and a valid usage authorization BER exists, then the controller ST1 produces a corresponding optical pattern MUS on the display DIP, for example two illuminated light-emitting diodes LED, while, if the prepayment card WEK is in the switched-off state, a pattern MUS which characterizes this state is produced, for example with none of the light-emitting diodes LED emitting light.

The pattern MUS is thus used to indicate whether the driver of the vehicle FAR is a potential or actual toll infringement.

For evidential purposes, the route positions or the signature SIG for the route STR and any information relating to the usage time, for example in the form of a time stub STE that is attached to the currently determined signature SIG, may be stored in a memory SP3 for the prepayment card WEK or for the billing center ABZ, and may be made available as required. This procedure makes it possible to avoid online communication between the toll payment apparatus and the billing center.

In order to prevent manipulation by the driver, something can be done either after a cycle which is stored in the prepayment card WEK or in the calculation unit OBU. In the case of the calculation unit OBU with a communication capability, the pattern may also be changed externally, for example via a GSM broadcast request.

The pattern change when using a calculation unit OBU that is capable of communication can also be initiated on a region-dependent basis, or can be initiated via the broadcast functionality of the mobile radio network by changing to a different mobile radio cell.

Thus, the valid pattern which corresponds to a permissible operating state is not fixed, but can also be initiated, for example, on the basis of a time pattern, on a position-dependent basis, or by external events such as the cell broadcast. This makes it possible to prevent goods vehicle drivers from driving around with dummy LEDs and becoming familiar with the pattern to be set.

When driving through a fixed monitoring station KST, this pattern can now be evaluated and can be used as a trigger signal for a license plate OCR. In addition to the low costs, the advantage of this solution is that it is not necessary to supply each vehicle with a license plate OCR.

The optical pattern is advantageously displayed as an infrared pattern. Infrared patterns can be identified by low-cost interference filters on an infrared camera KAM, with a correspondingly high light power level from the LEDs and with a very much higher signal-to-noise ratio than license plates with a purely passive license plate OCR. It is likewise possible to identify a number of simple patterns, much more reliably.

The monitoring system UES according to an embodiment of the invention is not used for communication, as in the case of WO 99/66455 that was mentioned initially, but is used to reduce the frequency of the license plates OCRs which are more complex and are considerably less reliable in the environmental conditions that are to be expected. The amount of data traffic between the fixed-position enforcement stations and the OCR control center is thus considerably reduced when the OCR is carried out centrally.

Mobile monitoring can likewise be carried out using an infrared camera. In addition to this, a preselection process can also be carried out via additional LED sources in the visible band. However, signaling may also in general take place in the visible band.

Three types of vehicles FAR may enter the booking region:

1. Vehicles FAR without or with an invalid (manipulated) IR/LED signature; there are either toll infringers, as are in principle possible with any given automatic toll methods or with toll participants with defective toll payment apparatuses BEV, or without or with invalid usage authorizations BER, for example a blocked account KON or consumed credit GUT. All of these participants can be identified in appropriate monitoring stations (fixed or mobile) and can be dealt with in accordance with the defined rules.

2. Vehicles with a valid IR/LED signature, with the leaving of a state region being identified and, for example, the communication of the toll payment apparatus BER with the billing center ABZ together with the toll payment process being deactivated, and only position finding now being carried out, or being switched to the toll system, whose basis technology is compatible, of a neighboring state or country.

3. Since the current position of the vehicle is known in the calculation unit BEE in the vehicle, and it is possible to use this to identify which coordinate point is located on this side or beyond the border, the current pattern can be activated in good time even before crossing a border on a route which is subject to a toll.

A tolerance zone is advantageously provided around the border, in which activation of the calculation unit is not absolutely essential. If a journey continues in a state region on a roadway that is subject to a toll, then the toll payment is made in accordance with the method according to an embodiment of the invention.

In summary, it can be stated that an embodiment of the invention allows monitoring of the correct operation of toll payment apparatuses to be ensured in a simple manner.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method for monitoring the correct operation of a toll payment apparatus involving a vehicle with a vehicle license number, comprising:

producing at least one optical signal, characteristic of the operating state of the toll payment apparatus, on the vehicle;

monitoring at least one of a status of a usage authorization and the status of the toll payment apparatus in terms of whether it is switched on or off, in at least one of a prepayment card and in a billing center, wherein the usage authorization is in at least one of a form of credit for toll fees incurred, in the form of a time card for the use of predetermined routes subject to a toll in a certain time period, in the form of route credits, and in the form of timings; and transmitting the usage authorization desired by a vehicle driver as a code to the toll payment apparatus, wherein the code is transmitted in a scrambled form.

2. The method as claimed in claim 1, wherein the optical signal is produced using at least one light-emitting diode.

3. The method as claimed in claim 1, wherein the optical signal is an infrared signal.

4. The method as claimed in claim 2, wherein the light-emitting diode is an infrared light-emitting diode.

5. The method as claimed in claim 1, wherein the optical signal is detected using an optically sensitive sensor.

6. The method as claimed in claim 1, wherein the optical signal is detected using an infrared camera.

7. The method as claimed in claim 1, wherein, for production of a signal which corresponds to incorrect operation of the toll payment apparatus, the license number of the vehicle is recorded as it passes a monitoring point.

8. A monitoring system for monitoring correct operation of a toll payment apparatus for a vehicle with a vehicle license number, wherein the monitoring system is designed to produce at least one optical signal at the vehicle, the signal being predeterminable and characteristic of the operating state of the toll payment apparatus, the system comprising:

a controller, designed to monitor at least one of status of a usage authorization in at least one of a prepayment card and a billing center and status of the toll payment apparatus in terms of whether it is switched on or off, wherein the usage authorization is in the form of at least one of credit for toll fees incurred, in the form of a time card for use of routes, which are predetermineable and subject to a toll in a certain time period, in the form of route credits, and in the form of timings, and wherein the usage authorization desired by a vehicle driver is transmitable as a scrambled code to the toll payment apparatus.

9. The monitoring system as claimed in claim 8, wherein at least one light-emitting diode is provided to produce the optical signal.

10. The monitoring system as claimed in claim 9, wherein the monitoring system is designed to produce an infrared signal.

11. The monitoring system as claimed in claim 10, wherein an infrared light-emitting diode is provided in order to produce the infrared signal.

12. The monitoring system as claimed in claim 8, wherein the monitoring system is designed to detect the optical signal using an optically sensitive sensor.

13. The monitoring system as claimed in claim 8, wherein the monitoring system is designed to detect the optical signal using an infrared camera.

14. The monitoring system as claimed in claim 8, wherein the monitoring system is designed to record the license number of the vehicle as it passes a monitoring point for production of a signal which corresponds to incorrect operation of the toll payment apparatus.

15. The method as claimed in claim 3, wherein the light-emitting diode is an infrared light-emitting diode.

16. The method as claimed in claim 2, wherein the optical signal is detected using an optically sensitive sensor.

17. The method as claimed in claim 2, wherein the optical signal is detected using an infrared camera.

18. The method as claimed in claim 3, wherein the optical signal is detected using an optically sensitive sensor.

19. The method as claimed in claim 3, wherein the optical signal is detected using an infrared camera.

20. The method as claimed in claim 2, wherein, for production of a signal which corresponds to incorrect operation of the toll payment apparatus, the license number of the vehicle is recorded as it passes a monitoring point.

21. The method as claimed in claim 3, wherein, for production of a signal which corresponds to incorrect operation of the toll payment apparatus, the license number of the vehicle is recorded as it passes a monitoring point.

22. The monitoring system as claimed in claim 9, wherein the monitoring system is designed to detect the optical signal using an optically sensitive sensor.

23. The monitoring system as claimed in claim 10, wherein the monitoring system is designed to detect the optical signal using an optically sensitive sensor.

24. The monitoring system as claimed in claim 9, wherein the monitoring system is designed to detect the optical signal using an infrared camera.

25. The monitoring system as claimed in claim 10, wherein the monitoring system is designed to detect the optical signal using an infrared camera.

26. The method as claimed in claim 1, wherein the optical signal includes a pattern.

27. The monitoring system as claimed in claim 8, wherein the optical signal includes a pattern.

* * * * *